US011378317B2

(12) United States Patent
Gokhale et al.

(10) Patent No.: US 11,378,317 B2
(45) **Date of Patent: *Jul. 5, 2022**

(54) METHOD AND SYSTEM FOR COMPRESSOR MODULATION IN NON-COMMUNICATING MODE

(71) Applicant: Lennox Industries Inc., Richardson, TX (US)

(72) Inventors: Umesh Gokhale, Irving, TX (US); Eric Berg, The Colony, TX (US)

(73) Assignee: Lennox Industries Inc., Richardson, TX (US)

( * ) Notice: Subject to any disclaimer, the term of this patent is extended or adjusted under 35 U.S.C. 154(b) by 6 days.

This patent is subject to a terminal disclaimer.

(21) Appl. No.: 17/122,247

(22) Filed: Dec. 15, 2020

(65) Prior Publication Data

US 2021/0095906 A1 Apr. 1, 2021

Related U.S. Application Data

(63) Continuation of application No. 16/261,910, filed on Jan. 30, 2019, now Pat. No. 10,895,413.

(51) Int. Cl.
*F25B 49/02* (2006.01)
*F25B 13/00* (2006.01)

(52) U.S. Cl.
CPC ..... *F25B 49/022* (2013.01); *F25B 13/00* (2013.01); *F25B 2600/01* (2013.01); *F25B 2600/0253* (2013.01); *F25B 2700/1931* (2013.01); *F25B 2700/1933* (2013.01); *F25B 2700/21152* (2013.01)

(58) Field of Classification Search
CPC .... F25B 49/022; F25B 13/00; F25B 2600/01; F25B 2600/0253; F25B 2700/1931; F25B 2700/1933; F25B 2700/21152
See application file for complete search history.

(56) References Cited

U.S. PATENT DOCUMENTS

| | | | | |
|---|---|---|---|---|
| 5,475,986 | A | 12/1995 | Bahel et al. | |
| 8,011,199 | B1 | 9/2011 | Chen et al. | |
| 9,121,628 | B2 * | 9/2015 | Chen | F25B 30/02 |
| 9,625,345 | B2 | 4/2017 | Berg et al. | |
| 9,726,412 | B2 | 8/2017 | Berg et al. | |
| 9,835,366 | B2 | 12/2017 | Berg et al. | |
| 10,018,394 | B2 | 7/2018 | Berg et al. | |
| 10,828,963 | B2 * | 11/2020 | Vehr | F25B 5/02 |
| 10,895,413 | B2 * | 1/2021 | Gokhale | F25B 49/02 |
| 2015/0059380 | A1 | 3/2015 | Takayama et al. | |

* cited by examiner

*Primary Examiner* — Marc E Norman
(74) *Attorney, Agent, or Firm* — Shackelford, Bowen, McKinley & Norton, LLP

(57) ABSTRACT

An HVAC system includes a pressure sensor is disposed in a suction line between a compressor and an indoor heat-exchange coil. The pressure sensor is electrically coupled to a compressor controller. An HVAC controller is electrically coupled to the compressor controller. The HVAC controller is configured to transmit a signal to the compressor controller to activate and de-activate the compressor. The compressor controller is configured to receive a signal from the HVAC controller to activate the compressor, determine a start speed of the compressor, monitor a run time of the compressor, and modulate a speed of the compressor.

20 Claims, 7 Drawing Sheets

METHOD AND SYSTEM FOR COMPRESSOR MODULATION IN NON-COMMUNICATING MODE

CROSS-REFERENCE TO RELATED APPLICATION

This application is a continuation of U.S. patent application Ser. No. 16/261,910, filed on Jan. 30, 2019. U.S. patent application Ser. No. 16/261,910 is incorporated herein by reference.

TECHNICAL FIELD

The present disclosure relates generally to heating, ventilation, and air conditioning (HVAC) systems and more particularly, but not by way of limitation, to utilizing a variable-speed compressor with an HVAC controller adapted for use with a single-speed compressor.

BACKGROUND

This section provides background information to facilitate a better understanding of the various aspects of the disclosure. It should be understood that the statements in this section of this document are to be read in this light, and not as admissions of prior art.

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air). To direct operation of the circulation fan and other components. HVAC systems include a controller. In addition to directing operation of the HVAC system, the controller may be used to monitor various components, (i.e. equipment) of the HVAC system to determine if the components are functioning properly.

SUMMARY

In an embodiment, aspects of the disclosure relate to a heating, ventilation, and air-conditioning (HVAC) system. The HVAC system includes an indoor unit. The indoor unit includes an indoor heat-exchange coil, an indoor circulation fan arranged to circulate air through the indoor heat-exchange coil, and a metering device fluidly coupled to the indoor heat-exchange coil. The HVAC system further includes an outdoor unit. The outdoor unit includes an outdoor heat-exchange coil, an outdoor circulation fan arranged to circulate air through the outdoor heat-exchange coil, a compressor fluidly coupled to the outdoor heat-exchange coil and fluidly coupled to the indoor heat-exchange coil, and a compressor controller electrically coupled to the compressor. A pressure sensor is disposed in a suction line between the compressor and the indoor heat-exchange coil. The pressure sensor is electrically coupled to the compressor controller. An HVAC controller is electrically coupled to the compressor controller. The HVAC controller is configured to transmit a signal to the compressor controller to at least one of activate and de-activate the compressor. The compressor controller is configured to receive a signal from the HVAC controller to activate the compressor, determine a start speed of the compressor, monitor a run time of the compressor, and modulate a speed of the compressor.

In an embodiment, aspects of the disclosure relate to a compressor system. The compressor system includes an outdoor heat-exchange coil, an outdoor circulation fan disposed arranged to circulate air through the outdoor heat-exchange coil, a compressor fluidly coupled to the outdoor heat-exchange coil, and a compressor controller electrically coupled to the compressor. The compressor controller is configured to receive a signal from an HVAC controller to activate the compressor, determine a start speed of the compressor, monitor a run time of the compressor, and modulate a speed of the compressor.

In an embodiment, aspects of the disclosure relate to a method of modulating a speed of a compressor. The method includes receiving a signal from an HVAC controller to at least one of activate and de-activate a compressor. A start speed of the compressor is determined. The compressor is activated at the determined start speed. A run time of the compressor is monitored. The run time of the compressor is compared to a desired cycle time of an HVAC system. A speed of the compressor is modulated.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
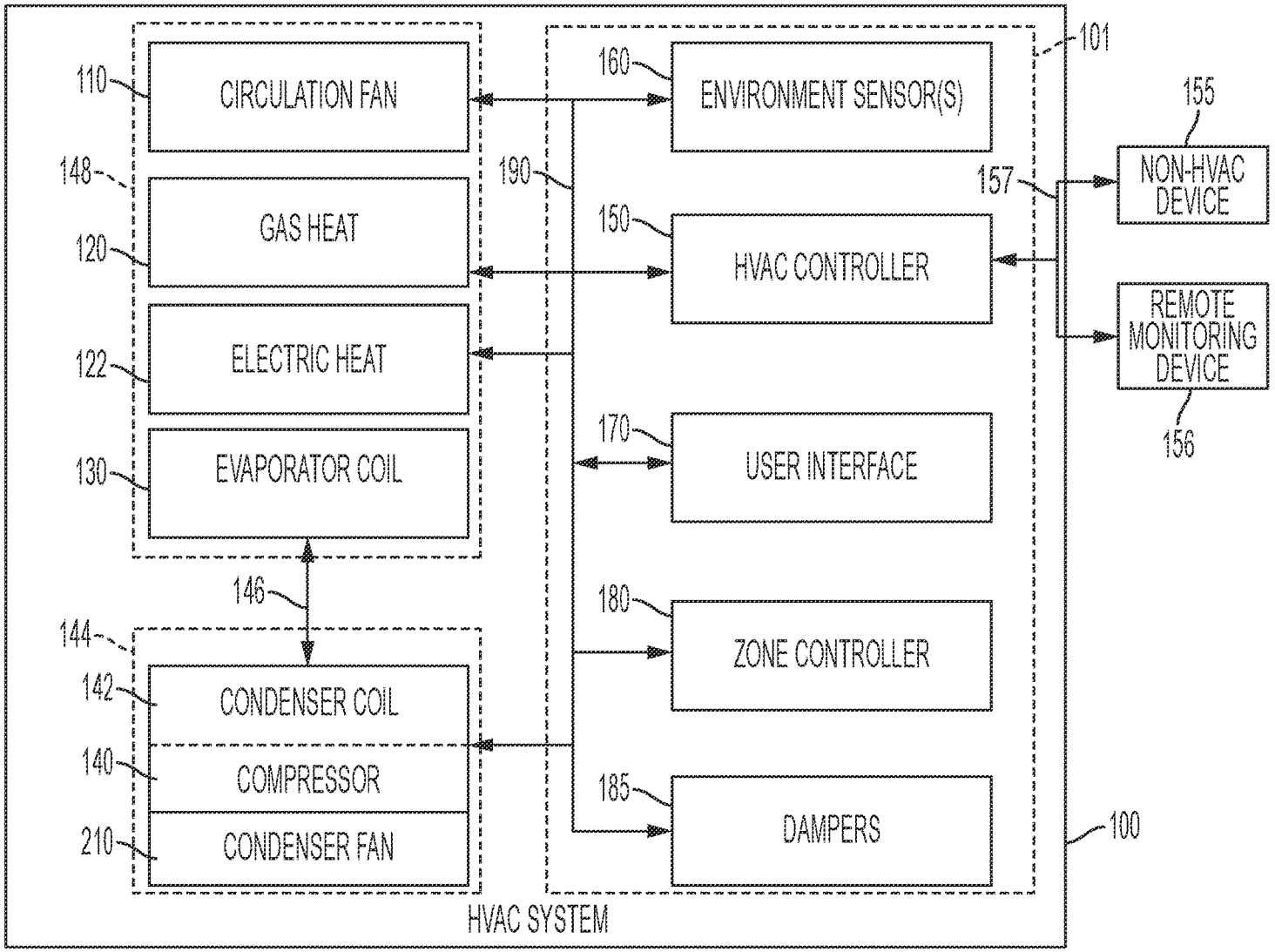
FIG. 1 is a block diagram of an HVAC system according to aspects of the disclosure.

Various embodiments will now be described more fully with reference to the accompanying drawings. The disclosure may, however, be embodied in many different forms and should not be construed as limited to the embodiments set forth herein.

HVAC systems are frequently utilized to adjust both temperature of conditioned air as well as relative humidity of the conditioned air. A cooling capacity of an HVAC system is a combination of the HVAC system's sensible cooling capacity and latent cooling capacity. Sensible cooling capacity refers to an ability of the HVAC system to remove sensible heat from conditioned air. Latent cooling capacity refers to an ability of the HVAC system to remove latent heat from conditioned air. In a typical embodiment, sensible cooling capacity and latent cooling capacity vary with environmental conditions. Sensible heat refers to heat that, when added to or removed from the conditioned air, results in a temperature change of the conditioned air. Latent heat refers to heat that, when added to or removed from the conditioned air, results in a phase change of, for example, water within the conditioned air. Sensible-to-total ratio ("S/T ratio") is a ratio of sensible heat to total heat (sensible heat+latent heat). The lower the S/T ratio, the higher the latent cooling capacity of the HVAC system for given environmental conditions.

Sensible cooling load refers to an amount of heat that must be removed from the enclosed space to accomplish a desired temperature change of the air within the enclosed space. The sensible cooling load is reflected by a temperature within the enclosed space as read on a dry-bulb thermometer. Latent cooling load refers to an amount of heat that must be removed from the enclosed space to accomplish a desired change in humidity of the air within the enclosed space. The latent cooling load is reflected by a temperature within the enclosed space as read on a wet-bulb thermometer. Setpoint or temperature setpoint refers to a target temperature setting of the HVAC system as set by a user or automatically based on a pre-defined schedule.

In situations where there is a high sensible cooling load such as, for example, when outside-air temperature is significantly warmer than an inside-air temperature setpoint, the HVAC system will continue to operate in an effort to effectively cool and dehumidify the conditioned air. When there is a low sensible cooling load but high relative humidity such as, for example, when the outside air temperature is relatively close to the inside air temperature setpoint, but the outside air is considerably more humid than the inside air, an HVAC system having a single-speed compressor will often repeatedly cycle between an active state and a de-activated state in an effort to provide de-humidification air while not over-conditioning the air. In such situations, a variable-speed compressor would allow the HVAC system to run in a more continuous fashion at a lower speed thereby providing more effective de-humidification of air.

FIG. 1 illustrates an HVAC system 100. In various embodiments, the HVAC system 100 is a networked HVAC system that is configured to condition air via, for example, heating, cooling, humidifying, or dehumidifying air within an enclosed space 101. In various embodiments, the enclosed space 101 is, for example, a house, an office building, a warehouse, or the like. Thus, the HVAC system 100 can be a residential system or a commercial system such as, for example, a roof top system. For exemplary illustration, the HVAC system 100 as illustrated in FIG. 1 includes various components; however, in other embodiments, the HVAC system 100 may include additional components that are not illustrated but may, in various embodiments, be included within HVAC systems.

The HVAC system 100 includes an indoor circulation fan 110 arranged to circulate air over an indoor heat-exchange coil 130, at least one of a gas heat 120 and an electric heat 122. The indoor circulation fan 110, at least one of the gas heat 120 and the electric heat 122, and the indoor heat-exchange coil 130 are collectively referred to as an "indoor unit" 148. In a typical embodiment, the indoor unit 148 is located within, or in close proximity to, the enclosed space 101. The HVAC system 100 also includes a compressor 140, an associated outdoor heat-exchange coil 142, and an outdoor circulation fan 210, which are typically referred to as an "outdoor unit" 144. In various embodiments, the outdoor unit 144 is, for example, a rooftop unit or a ground-level unit. The compressor 140 and the associated outdoor heat-exchange coil 142 are connected to the indoor heat-exchange coil 130 by a refrigerant line 146. In various embodiments, as will be discussed in more detail below, the compressor 140 may be, for example, a single-speed compressor, a variable-speed compressor, a single-stage compressor or a multi-stage compressor. In various embodiments, the indoor circulation fan 110, sometimes referred to as a blower, is configured to operate at different capacities (i.e., variable motor speeds) to circulate air through the HVAC system 100, whereby the circulated air is conditioned and supplied to the enclosed space 101.

Still referring to FIG. 1, the HVAC system 100 includes an HVAC controller 150 that is configured to control operation of the various components of the HVAC system 100 such as, for example, the indoor circulation fan 110, at least one of the gas heat 120 and the electric heat 122, and the compressor 140 to regulate the environment of the enclosed space 101. In some embodiments, the HVAC system 100 can be a zoned system. In such embodiments, the HVAC system 100 includes a zone controller 180, dampers 185, and a plurality of environment sensors 160. In a typical embodiment, the HVAC controller 150 cooperates with the zone controller 180 and the dampers 185 to regulate the environment of the enclosed space 101. In various embodiments, particularly embodiments where the compressor 140 is a single-speed compressor, the HVAC controller 150 communicates an on/off signal to the compressor 140 via, for example, a 24 Volt alternating-current (VAC) signal.

In various embodiments, particularly embodiments where the compressor 140 is a variable-speed compressor, the HVAC controller 150 may be an integrated controller or a distributed controller that directs operation of the HVAC system 100. In various embodiments, the HVAC controller 150 includes an interface to receive, for example, thermostat calls, temperature setpoints, blower control signals, environmental conditions, and operating mode status for various zones of the HVAC system 100. For example, in a typical embodiment, the environmental conditions may include indoor temperature and relative humidity of the enclosed space 101. In various embodiments, the HVAC controller 150 also includes a processor and a memory to direct operation of the HVAC system 100 including, for example, a speed of the compressor 140.

Still referring to FIG. 1, in some embodiments, the plurality of environment sensors 160 are associated with the HVAC controller 150 and also optionally associated with a user interface 170. The plurality of environment sensors 160 provides environmental information within a zone or zones of the enclosed space 101 such as, for example, temperature and humidity of the enclosed space 101 to the HVAC controller 150. The plurality of environment sensors 160 may also send the environmental information to a display of the user interface 170. In some embodiments, the user interface 170 provides additional functions such as, for example, operational, diagnostic, status message display, and a visual interface that allows at least one of an installer, a user, a support entity, and a service provider to perform actions with respect to the HVAC system 100. In some embodiments, the user interface 170 is, for example, a thermostat of the HVAC system 100. In other embodiments, the user interface 170 is associated with at least one sensor of the plurality of environment sensors 160 to determine the environmental condition information and communicate that information to the user. The user interface 170 may also include a display, buttons, a microphone, a speaker, or other components to communicate with the user. Additionally, the user interface 170 may include a processor and memory that is configured to receive user-determined parameters such as, for example, a relative humidity of the enclosed space 101, and calculate operational parameters of the HVAC system 100 as disclosed herein.

In a typical embodiment, the HVAC system 100 is configured to communicate with a plurality of devices such as, for example, a monitoring device 156, a communication device 155, and the like. In a typical embodiment, the monitoring device 156 is not part of the HVAC system. For example, the monitoring device 156 is a server or computer of a third party such as, for example, a manufacturer, a support entity, a service provider, and the like. In other embodiments, the monitoring device 156 is located at an office of, for example, the manufacturer, the support entity, the service provider, and the like.

In various embodiments, the communication device 155 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In various embodiments, the communication device 155 includes at least one processor, memory and a user interface, such as a display. One skilled in the art will also understand that the communication device 155 disclosed herein includes other components that are typically included in such devices including, for example, a power supply, a communications interface, and the like.

The zone controller 180 is configured to manage movement of conditioned air to designated zones of the enclosed space 101. Each of the designated zones include at least one conditioning or demand unit such as, for example, the gas heat 120 and at least one user interface 170 such as, for example, the thermostat. The zone-controlled HVAC system 100 allows the user to independently control the temperature in the designated zones. In various embodiments, the zone controller 180 operates electronic dampers 185 to control air flow to the zones of the enclosed space 101.

In some embodiments, a data bus 190, which in the illustrated embodiment is a serial bus, couples various components of the HVAC system 100 together such that data is communicated therebetween. In a typical embodiment, the data bus 190 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PC-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 150 to other components of the HVAC system 100. In other embodiments, connections between various components of the HVAC system 100 are wired. For example, conventional cable and contacts may be used to couple the HVAC controller 150 to the various components. In some embodiments, a wireless connection is employed to provide at least some of the connections between components of the HVAC system such as, for example, a connection between the HVAC controller 150 and the indoor circulation fan 110 or the plurality of environment sensors 160.

Figure 2:
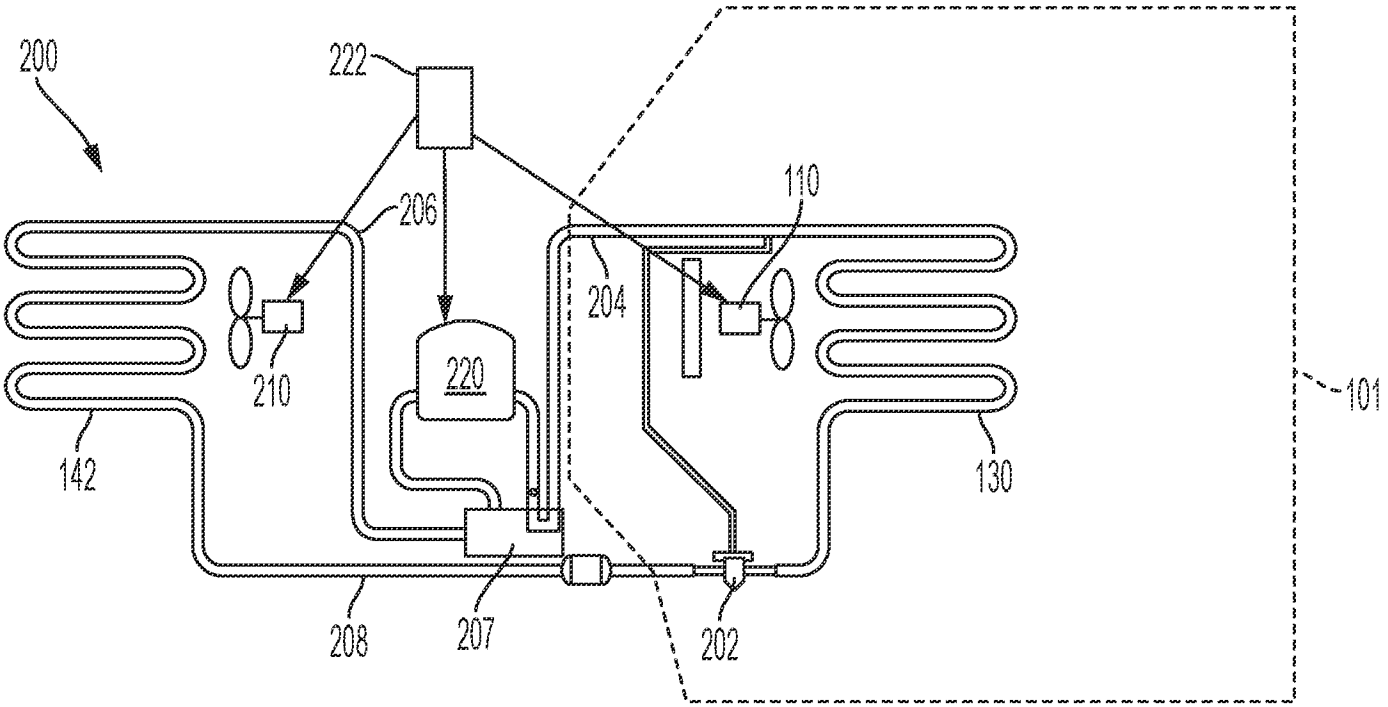
FIG. 2 is a schematic diagram of an HVAC system having a single-speed compressor according to aspects of the disclosure.

FIG. 2 is a schematic diagram of an HVAC system 200 having a single-speed compressor 220. For illustrative purposes, FIG. 2 will be described herein relative to FIG. 1. In various embodiments, the HVAC system 200 may operate in a heating mode or an air-conditioning mode. The HVAC system 200 includes the indoor heat-exchange coil 130, the outdoor heat-exchange coil 142, a single-speed compressor 220, and a metering device 202. In a typical embodiment, the metering device 202 is, for example, a thermal expansion valve or a throttling valve. The indoor heat-exchange coil 130 is fluidly coupled to the single-speed compressor 220 via a suction line 204. The single-speed compressor 220 is fluidly coupled to the outdoor heat-exchange coil 142 via a discharge line 206. The outdoor heat-exchange coil 142 is fluidly coupled to the metering device 202 via a liquid line 208.

Still referring to FIG. 2, during operation, low-pressure, low-temperature refrigerant is circulated through the indoor heat-exchange coil 130. The refrigerant is initially in a liquid/vapor state. In a typical embodiment, the refrigerant is, for example, R-22, R-134a, R-410A, R-744, or any other suitable type of refrigerant as dictated by design requirements. Air from within the enclosed space 101 is circulated around the indoor heat-exchange coil 130 by the indoor circulation fan 110. When the HVAC system 200 operates in the air-conditioning mode, the indoor heat-exchange coil 130 functions as an evaporator. Thus, the refrigerant begins to boil after absorbing heat from the air and changes state to a low-pressure, low-temperature, super-heated vapor refrigerant. Saturated vapor, saturated liquid, and saturated fluid refer to a thermodynamic state where a liquid and its vapor exist in approximate equilibrium with each other. Superheated fluid and super-heated vapor refer to a thermodynamic state where a vapor is heated above a saturation temperature of the vapor. Sub-cooled fluid and sub-cooled liquid refer to a thermodynamic state where a liquid is cooled below the saturation temperature of the liquid.

The low-pressure, low-temperature, super-heated vapor refrigerant is introduced into the single-speed compressor 220 via the suction line 204. In a typical embodiment, the single-speed compressor 220 increases the pressure of the low-pressure, low-temperature, super-heated vapor refrigerant and, by operation of the ideal gas law, also increases the temperature of the low-pressure, low-temperature, superheated vapor refrigerant to form a high-pressure, high-temperature, superheated vapor refrigerant. The high-pressure, high-temperature, superheated vapor refrigerant leaves the single-speed compressor 220 via the discharge line 206 and is directed to the outdoor heat-exchange coil 142.

Outside air is circulated around the outdoor heat-exchange coil 142 by an outdoor circulation fan 210. When the HVAC system 200 is operating in the air-conditioning mode, the outdoor heat-exchange coil 142 functions as a condenser. Thus, in the air-conditioning mode, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the outdoor heat-exchange coil 142 via the liquid line 208 and enters the metering device 202.

Still referring to FIG. 2, when the HVAC system 200 is operating in the heating mode, the direction of refrigerant flow is reversed. Thus, in the heating mode, the indoor heat-exchange coil 130 functions as a condenser and the outdoor heat-exchange coil 142 functions as an evaporator. In various embodiments, reversal of refrigerant flow is accomplished by a reversing valve 207.

In the metering device 202, the pressure of the high-pressure, high-temperature, sub-cooled liquid refrigerant is abruptly reduced. In various embodiments where the metering device 202 is, for example, a thermal expansion valve, the metering device 202 reduces the pressure of the high-pressure, high-temperature, sub-cooled liquid refrigerant by regulating an amount of refrigerant that travels to the indoor heat-exchange coil 130. Abrupt reduction of the pressure of the high-pressure, high-temperature, sub-cooled liquid refrigerant causes sudden, rapid, evaporation of a portion of the high-pressure, high-temperature, sub-cooled liquid refrigerant, commonly known as "flash evaporation." The flash evaporation lowers the temperature of the resulting liquid/vapor refrigerant mixture to a temperature lower than a temperature of the air in the enclosed space 101. The liquid/vapor refrigerant mixture leaves the metering device 202 and returns to the indoor heat-exchange coil 130.

Still referring to FIG. 2, an HVAC controller 222 is electrically coupled to the single-speed compressor 220, the indoor circulation fan 110, and the outdoor circulation fan 210. When the HVAC system 200 is operating in the heating mode and the air-conditioning mode, the HVAC controller 222 provides, for example, a 24 VAC signal to the single-speed compressor 220 causing the single-speed compressor 220 to cycle between an activated state and a de-activated state.

During the life of the HVAC system 200, it may be desirable to replace the outdoor unit 144 having the single-speed compressor 220 with an outdoor unit having a variable-speed compressor. In most cases, however, the HVAC controller 222 associated with the single-speed compressor 220 cannot provide the signal required to modulate a speed of a variable-speed compressor.

Figure 3:
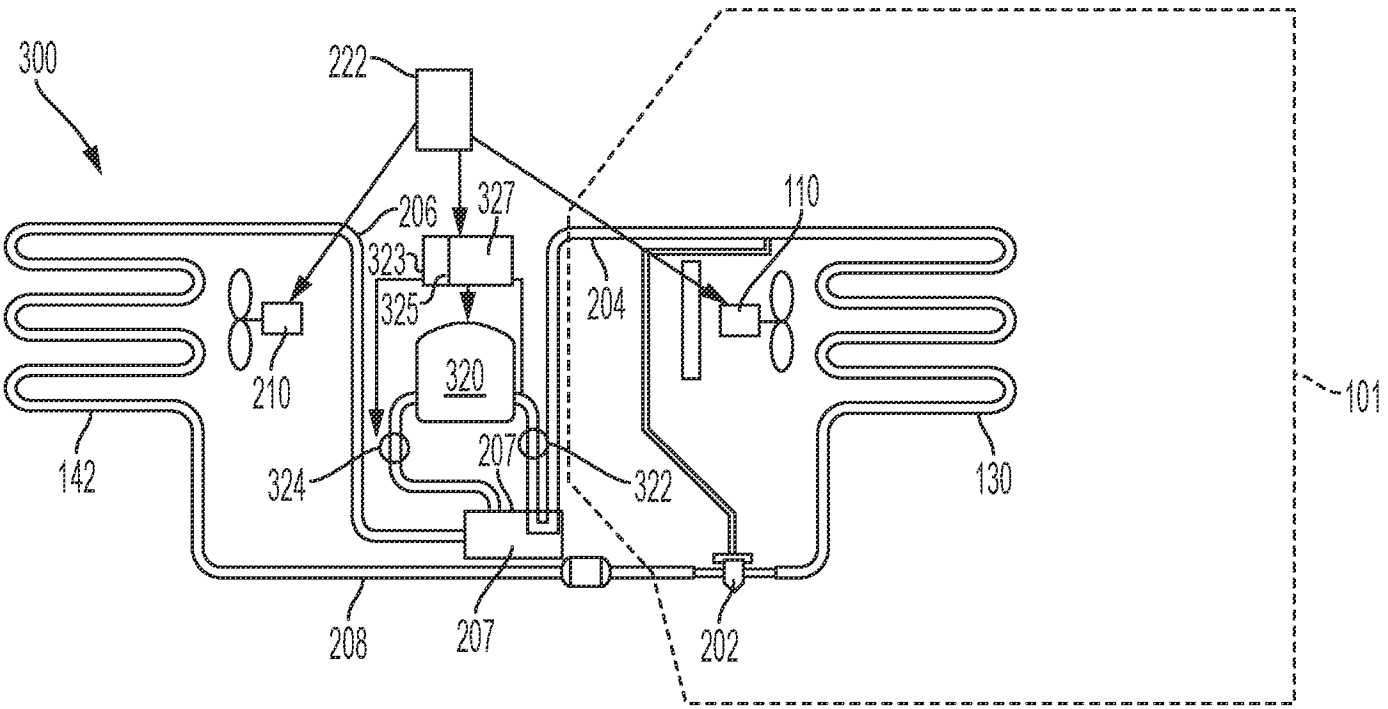
FIG. 3 is a schematic diagram of the HVAC system where the single-speed compressor has been replaced with a variable-speed compressor according to aspects of the disclosure.

FIG. 3 is a schematic diagram of the HVAC system 300 where the single-speed compressor 220 has been replaced with a variable-speed compressor 320. For illustrative purposes, FIG. 3 will be described herein relative to FIGS. 1-2. A compressor controller 323 is electrically coupled to the variable-speed compressor 320 and the HVAC controller 222. A pressure sensor 322 is disposed in the suction line 204 on a suction side of the variable-speed compressor 320 and is electrically coupled to the compressor controller 323. In various embodiments, the pressure sensor 322 is, for example, a pressure transducer. A temperature sensor 324 is disposed in the discharge line 206 on a discharge side of the variable-speed compressor 320 and is configured to measure a refrigerant temperature in the discharge line 206. During operation, the compressor controller 323 modulates the speed of the variable-speed compressor 320 in an effort to optimize the run time of the HVAC system 300. In various embodiments, it is desirable to have the variable-speed compressor 320 run as much as possible in an effort to improve thermal comfort in the enclosed space 101 and to reduce energy consumption due to cycling losses. During operation, the HVAC controller 222 provides a cooling signal (also referred to as a "Y call") to the compressor controller 323 to activate or deactivate the variable-speed compressor 320. In various embodiments, the compressor controller 323 may be, for example, a motor control unit, a PID controller, or other appropriate controller. The compressor controller 323 includes a timer unit 325 and a processor 327. In various embodiments, the timer unit 325 is configured to monitor a run time of the variable-speed compressor 320. That is, the timer unit 325 measures an amount of time that the variable-speed compressor 320 is activated. The processor 327 is configured to provide a signal to the variable-speed compressor 320 to modulate a speed of the variable-speed compressor 320.

Still referring to FIG. 3, when the HVAC system 300 is operating in the air-conditioning mode, as a cooling load in the enclosed space 101 increases, refrigerant pressure in the suction line 204 increases. In various embodiments, a speed of the variable-speed compressor 320 is increased in an effort to lower the refrigerant pressure in the suction line 204. Similarly, when the cooling load in the enclosed space 101 decreases, the refrigerant pressure in the suction line 204 decreases. In various embodiments, the speed of the variable-speed compressor 320 is decreased in an effort to raise the refrigerant pressure in the suction line 204.

Still referring to FIG. 3, when the HVAC system 300 is operating in the heating mode, as a heating load in the enclosed space 101 increases, the refrigerant temperature in the discharge line 206 decreases. In various embodiments, a speed of the variable-speed compressor 320 is increased in an effort to raise the refrigerant temperature in the discharge line 206. Similarly, when the heating load in the enclosed space 101 decreases, the refrigerant temperature in the discharge line 206 increases. In various embodiments, the speed of the variable-speed compressor 320 is decreased in an effort to lower the refrigerant temperature in the discharge line 206.

Figure 4A:
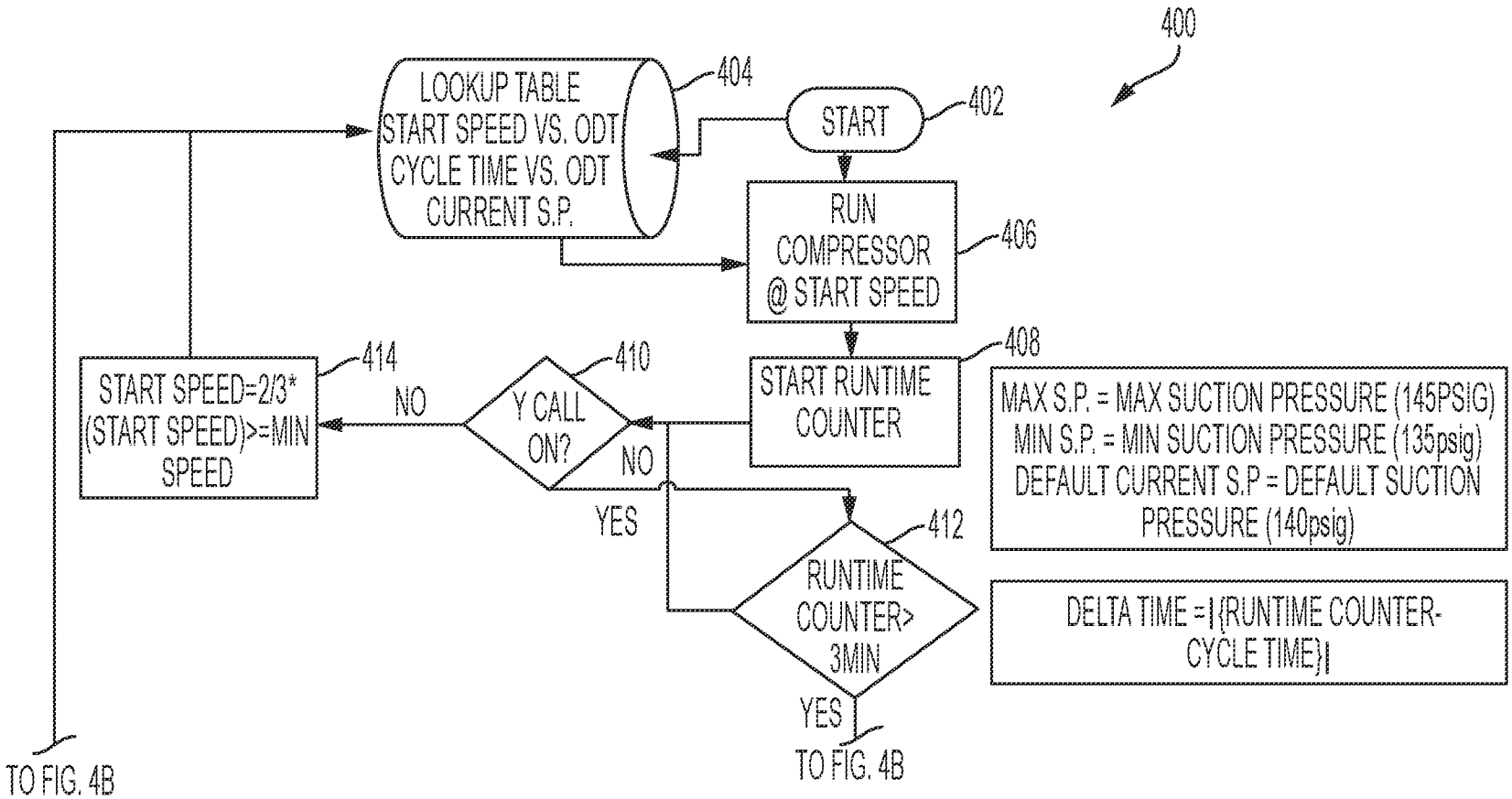
FIGS. 4A-4B illustrate a flow diagram of a process for modulating compressor speed according to aspects of the disclosure.
Figure 4B:
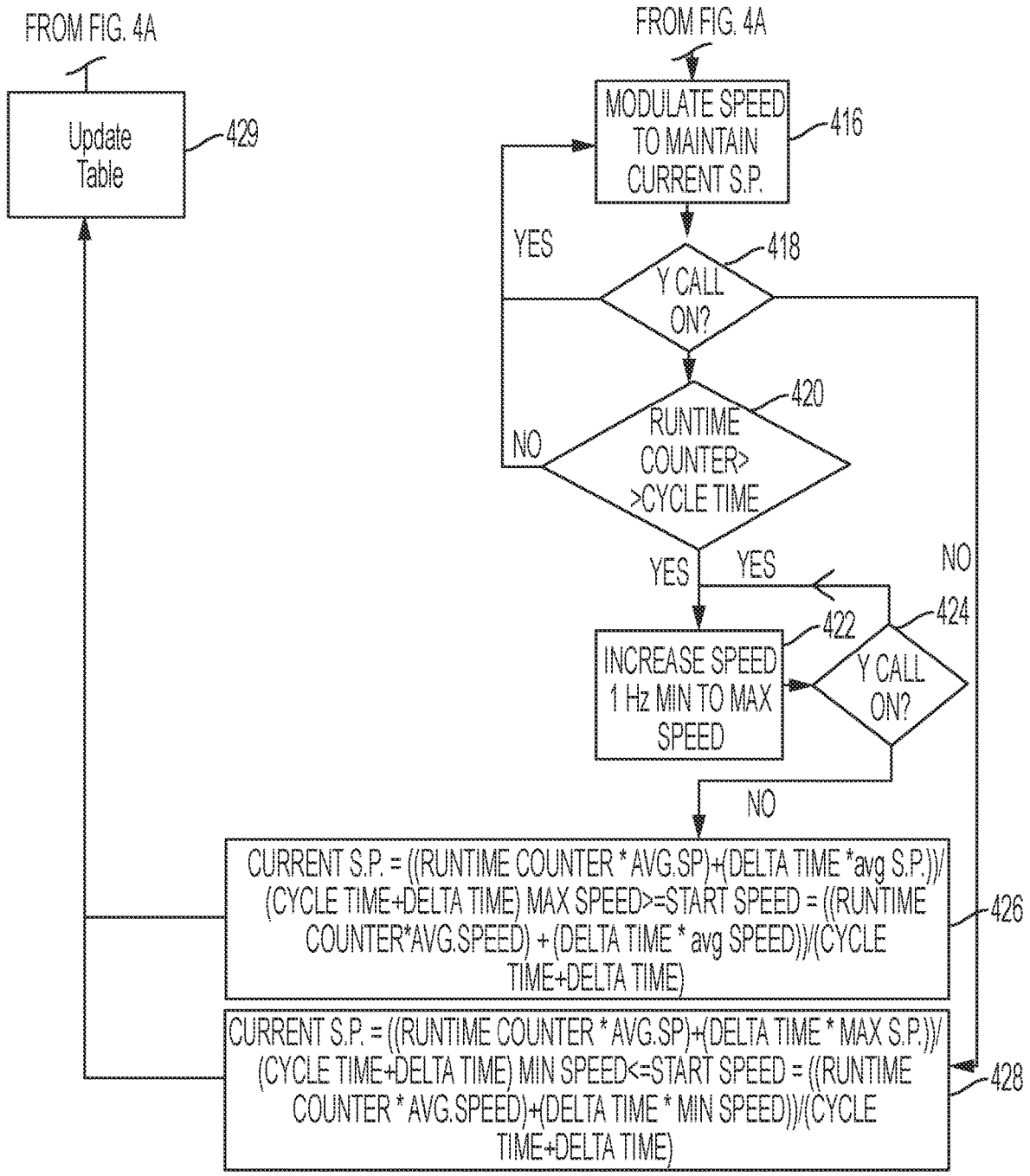

FIGS. 4A-4B illustrate a flow diagram of a process 400 for modulating a speed of the variable-speed compressor 320. For illustrative purposes, FIGS. 4A-4B will be described herein relative to FIGS. 1-3. The process 400 begins at step 402. At step 404, a start speed of the variable-speed compressor 320 is determined. In various embodiments, the start speed may be determined, for example, as a function of outdoor temperature, suction pressure, and HVAC system 300 cycle time. In one embodiment, the start speed of the variable-speed compressor 320 may be determined utilizing, for example, a lookup table as illustrated at step 404. At step 406, the compressor controller 323 signals the variable-speed compressor 320 to activate at the start speed determined in step 404. In various embodiments, the compressor controller 323 signals the variable-speed compressor 320 to activate responsive to a Y call received from the HVAC controller 222. In various embodiments, the Y call is, for example, a 24 VAC signal. At step 408, the timer unit 325 begins to monitor the run time of the variable-speed compressor 320. At step 410, it is determined if the compressor controller 323 is receiving a Y call from the HVAC controller 222. If, at step 410, the compressor controller 323 is receiving a Y call from the HVAC controller 222, the process 400 proceeds to step 412. If, at step 410, it is determined that the compressor controller 323 is not receiving a Y call from the HVAC controller 222, the process 400 proceeds to step 414. At step 414, the start speed of the variable-speed compressor 320 is reduced. In various embodiments, the start speed may be reduced to a value that is, for example, approximately two thirds of the original start speed of the variable-speed compressor 320 provided that the start speed of the variable-speed compressor 320 remains above a minimum rated speed of the variable-speed compressor 320. From step 414, the process 400 returns to step 404.

Still referring to FIGS. 4A-4B, at step 412, it is determined if the run time of the variable-speed compressor 320, monitored by the timer unit 325, is greater than a minimum threshold. In various embodiments, the minimum threshold may be, for example, five minutes; however, in other embodiments, other time thresholds could be utilized. If, at step 412, it is determined that the run time of the variable-speed compressor 320 is not above the minimum threshold, the process 400 returns to step 410. If, at step 412, it is determined that the run time of the variable-speed compressor 320 is above the minimum threshold, the process 400 proceeds to step 416. At step 416, when the HVAC system 300 is operating in the air-conditioning mode, the compressor controller 323 modulates a speed of the variable-speed compressor 320 in an effort to maintain a pressure in the suction line 204 measured by the pressure sensor 322. In an alternative embodiment, a pressure switch (not shown) may be disposed in the suction line 204. The pressure switch is electrically coupled to the compressor controller 323. In such an embodiment, the pressure switch could be calibrated to open when the pressure in the suction line 204 reaches, for example, approximately 140 psig and calibrated to close when the pressure in the suction line 204 falls to, for example, approximately 130 psig. In such an embodiment, the variable-speed compressor 320 would increase in speed until the pressure switch closes at approximately 130 psig. Subsequently, the variable-speed compressor 320 would decrease in speed until the pressure switch opens at approximately 140 psig. In a typical embodiment, a speed of the variable-speed compressor 320 is in the range of approximately 20 Hz to approximately 60 Hz.

Still referring to FIGS. 4A-4B, when the HVAC system 300 is operating in the heating mode, the compressor controller 323 modulates a speed of the variable-speed compressor 320 in an effort to maintain a temperature in the discharge line 206 measured by the temperature sensor 324. In an alternative embodiment, a pressure switch (not shown) may be disposed in the discharge line 206. In such an embodiment, the pressure switch could be calibrated to open when the pressure in the discharge line 206 reaches, for example, approximately 400 psig and calibrated to close when the pressure in the discharge line 206 falls to, for example, approximately 350 psig. In such an embodiment, the variable-speed compressor 320 would increase in speed until the pressure switch closes at approximately 350 psig. Subsequently, the variable-speed compressor 320 would decrease in speed until the pressure switch opens at approximately 400 psig.

Still referring to FIGS. 4A-4B, at step 418, it is determined if the compressor controller 323 is receiving a Y call from the HVAC controller 222. If, at step 418, it is determined that the compressor controller 323 is receiving a Y call from the HVAC controller 222, the process 400 proceeds to step 420. If, at step 418, it is determined that the compressor controller 323 is not receiving a Y call from the HVAC controller 222, the process 400 proceeds to step 428.

Still referring to FIGS. 4A-4B, at step 420, it is determined if the run time of the variable-speed compressor 320, monitored by the timer unit 325 is greater than or equal to a desired cycle time. In various embodiments, the desired cycle time is in the range of approximately 20 minutes to approximately 30 minutes. If, at step 420, it is determined that the run time of the variable-speed compressor 320 is not greater than or equal to the desired cycle time, the process 400 returns to step 416. If, at step 420, it is determined that the run time of the variable-speed compressor 320 is greater than or equal to the desired cycle time, the process 400 proceeds to step 422. At step 422, the compressor controller 323 increases the speed of the variable-speed compressor 320. In various embodiments, the compressor controller 323 increases a speed of the variable-speed compressor 320 by, for example, 1 Hz, provided that the speed of the variable-speed compressor 320 remains below a maximum-rated speed of the variable-speed compressor 320. At step 424, it is determined if the compressor controller 323 is receiving a Y call from the HVAC controller 222. If, at step 424, it is determined that the compressor controller 323 is receiving a Y call from the HVAC controller 222, the process 400 returns to step 422. If, at step 424, it is determined that the compressor controller 323 is not receiving a Y call from the HVAC controller 222, the process 400 proceeds to step 426.

Still referring to FIGS. 4A-4B, at step 426, the suction pressure and the start speed of the variable-speed compressor 320 are adjusted as a function of the monitored run time of the variable-speed compressor 320. Likewise, at step 428, the suction pressure and the start speed of the variable-speed compressor 320 are adjusted as a function of the monitored run time of the variable-speed compressor 320. That is, if the run time of the variable-speed compressor 320 is short, it is indicative of a target suction pressure that is too low thereby causing the variable-speed compressor 320 to run at a higher speed. In an effort to increase a run time of the variable-speed compressor 320, the suction pressure target could be increased and the starting speed of the variable-speed compressor 320 could be decreased. From step 426 and step 428, the process 400 proceeds to step 429 where the lookup table is updated. From step 429 the process 400 returns to step 404. In various embodiments, the process 400 ends when the Y call ceases. When the Y call ceases, the suction pressure target and the start speed of the variable-speed compressor 320 are updated.

Figure 5:
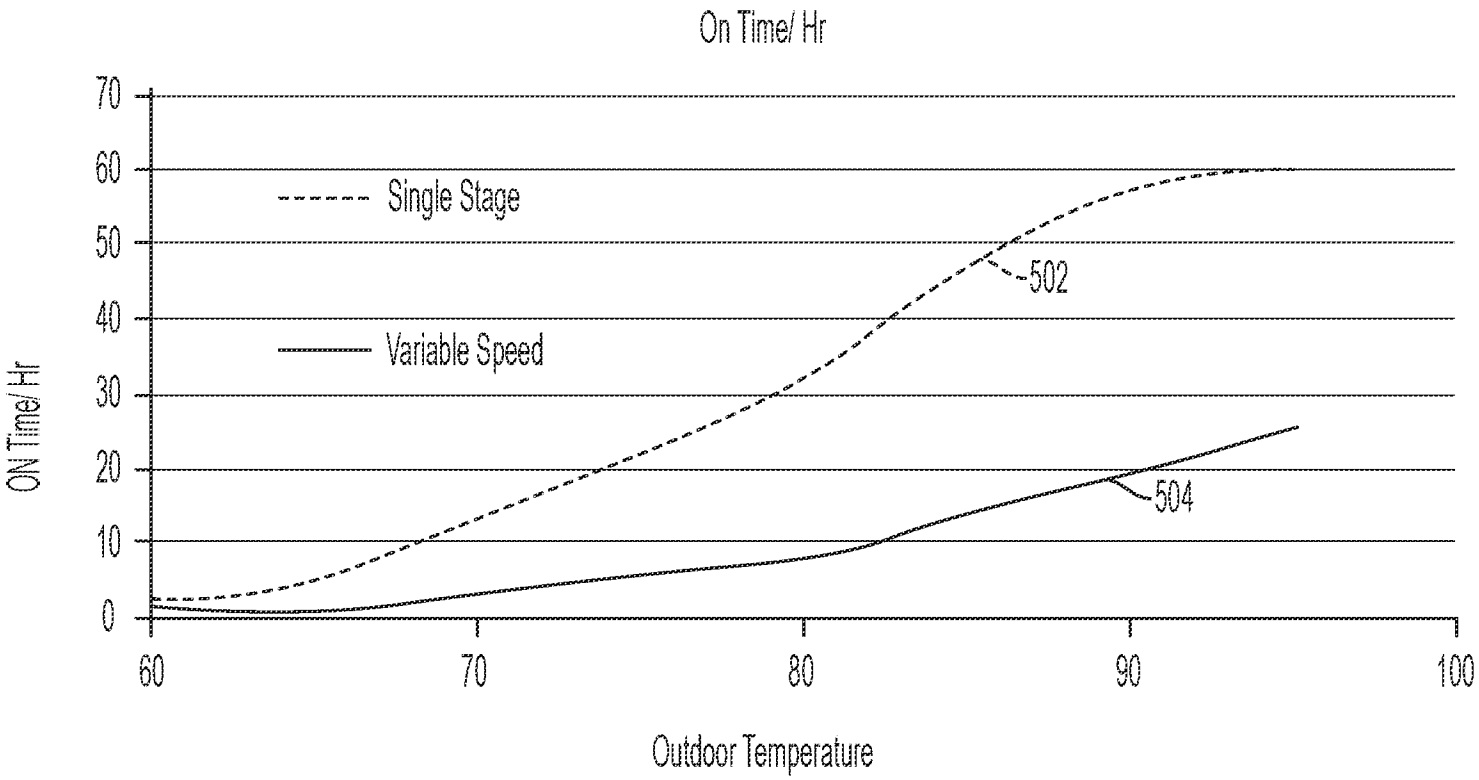
FIG. 5 is a graph illustrating a relationship between HVAC system run time and outdoor temperature.

FIG. 5 is a graph 500 illustrating a relationship between HVAC system run time and outdoor temperature. An HVAC system having the variable-speed compressor 320 is illustrated by the line 502. An HVAC system having the single-speed compressor 220 is illustrated by the line 504. The graph 500 demonstrates that, as outdoor temperature increases, the HVAC system having the variable-speed compressor 320 is capable of more extended run time than the HVAC system having the single-speed compressor 220. This allows the HVAC system having the variable-speed compressor 320 to increase the run time of the HVAC system while operating the variable-speed compressor 320 at a lower speed that would normally be utilized by the HVAC system having the single-speed compressor 220. The extended run time of the variable-speed compressor 320 is beneficial for thermal comfort, improved humidity control, and reduced energy consumption.

Figure 6:
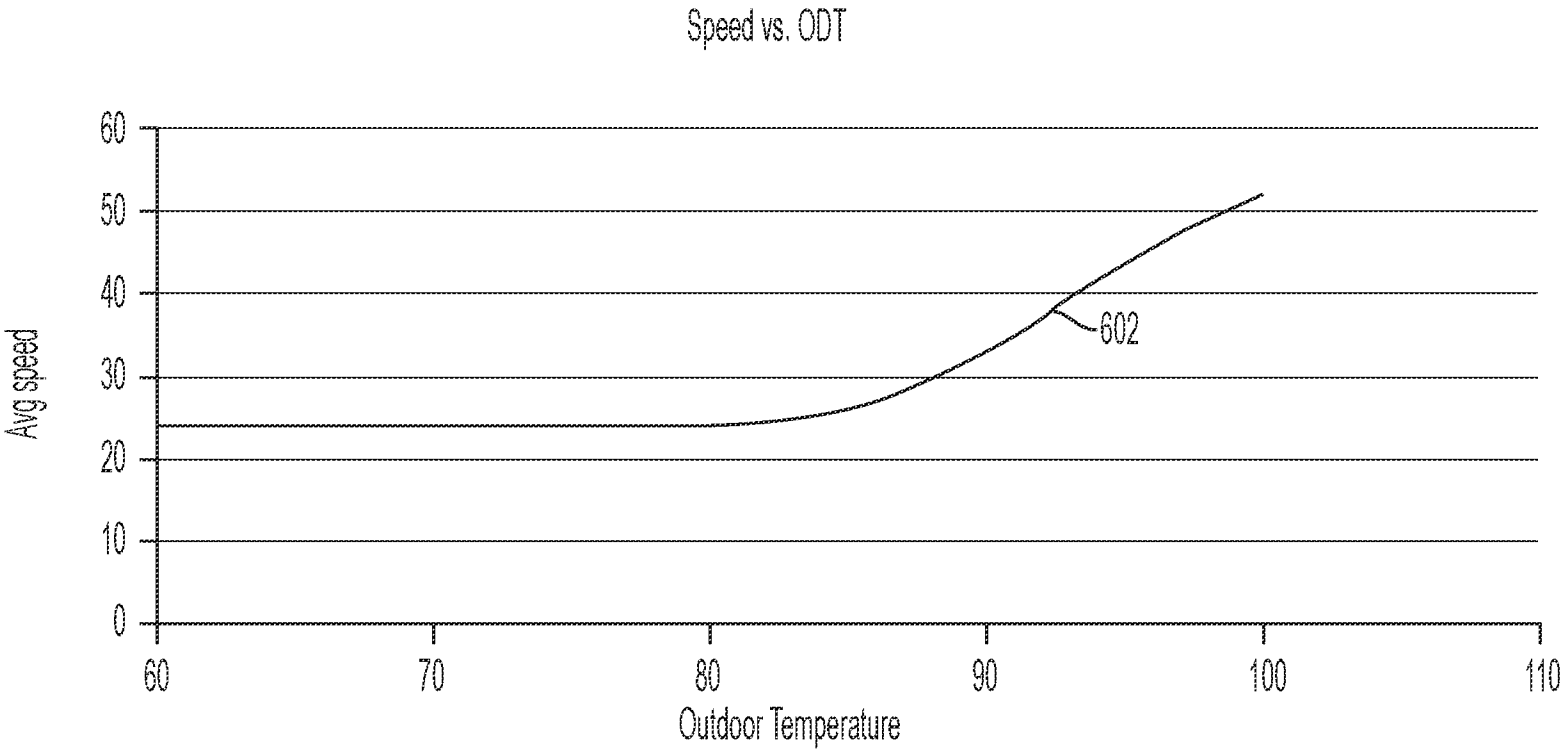
FIG. 6 is a graph illustrating a relationship between average compressor speed and outdoor temperature.

FIG. 6 is a graph illustrating a relationship between average compressor speed and outdoor temperature. The line 602 illustrates that, as outdoor temperature increases, the average compressor speed of the HVAC system having the variable-speed compressor 320 increases.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately." "generally." and "about" may be substituted with "within 10% of" what is specified.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

Particular embodiments may include one or more computer-readable storage media implementing any suitable storage. In particular embodiments, a computer-readable storage medium implements one or more portions of the HVAC controller 150, one or more portions of the user interface 170, one or more portions of the zone controller 180, or a combination of these, where appropriate. In particular embodiments, a computer-readable storage medium implements RAM or ROM. In particular embodiments, a computer-readable storage medium implements volatile or persistent memory. In particular embodiments, one or more computer-readable storage media embody encoded software.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C. Python. Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML). Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A method of modulating a speed of a compressor, the method comprising:

receiving a signal from an HVAC controller to at least one of activate and de-activate the compressor;

determining a start speed of the compressor;

activating the compressor at the determined start speed;

monitoring a run time of the compressor;

determining whether the run time of the compressor is greater than a minimum run time;

responsive to a determination that the run time of the compressor is greater than the minimum run time, modulate a speed of the compressor to maintain a desired suction pressure;

determining whether the run time of the compressor is greater than or equal to a desired cycle time; and responsive to a determination that the run time of the compressor is greater than or equal to the desired cycle time, increase the speed of the compressor to lower the desired suction pressure.

2. The method of claim 1, wherein the modulating the speed of the compressor comprises modulating the speed of the compressor responsive to a suction pressure measured by a pressure sensor when the HVAC system is operating in an air-conditioning mode.

3. The method of claim 1, wherein the modulating the speed of the compressor comprises modulating the speed of the compressor responsive to at least one of a discharge refrigerant temperature measured by a temperature sensor and a discharge refrigerant pressure measured by a pressure sensor when the HVAC system is operating in a heating mode.

4. The method of claim 1, comprising increasing the start speed of the compressor responsive to the run time exceeding the desired cycle time of the HVAC system.

5. The method of claim 1, comprising decreasing the start speed of the compressor responsive to the run time being below a minimum threshold.

6. The method of claim 1, wherein the signal received from the HVAC controller is a 24V AC signal.

7. The method of claim 1, comprising responsive to a determination that the run time of the compressor is less than the minimum run time, returning to the receiving step.

8. A heating, ventilation, and air-conditioning (HVAC) system comprising:

an indoor circulation fan arranged to circulate air through an indoor heat-exchange coil;

an outdoor circulation fan arranged to circulate air through an outdoor heat-exchange coil;

a compressor fluidly coupled to the outdoor heat-exchange coil and fluidly coupled to the indoor heat-exchange coil;

a compressor controller electrically coupled to the compressor;

an HVAC controller electrically coupled to the compressor controller, the HVAC controller configured to transmit a signal to the compressor controller to at least one of activate and de-activate the compressor;

the compressor controller configured to:

receive a signal from the HVAC controller to activate the compressor;

determine a start speed of the compressor;

monitor a run time of the compressor relative to a minimum run time and a desired cycle time;

determine whether the run time of the compressor is greater than a minimum run time;

responsive to a determination that the run time of the compressor is greater than the minimum run time, modulate a speed of the compressor to maintain a desired suction pressure;

determine whether the run time of the compressor is greater than or equal to a desired cycle time; and responsive to a determination that the run time of the compressor is greater than or equal to the desired cycle time, increase the speed of the compressor to lower the desired suction pressure.

9. The HVAC system of claim 8, wherein the HVAC system operates in at least one of an air-conditioning mode and a heating mode.

10. The HVAC system of claim 9, wherein, when the HVAC system operates in the air-conditioning mode, the compressor controller modulates the speed of the compressor responsive to a suction pressure measured by a pressure sensor.

11. The HVAC system of claim 8, comprising at least one of:

a temperature sensor disposed in a discharge line between the compressor and the outdoor heat-exchange coil, the temperature sensor being electrically coupled to the compressor controller; and a pressure sensor disposed in the discharge line, the pressure sensor being electrically coupled to the compressor controller.

12. The HVAC system of claim 11, wherein, when the HVAC system operates in the heating mode, the compressor controller modulates the speed of the compressor responsive to a refrigerant temperature in a discharge line measured by the temperature sensor.

13. The HVAC system of claim 11, wherein, when the HVAC system operates in the heating mode, the compressor controller modulates the speed of the compressor responsive to a refrigerant pressure in the discharge line measured by the pressure sensor.

14. A compressor system comprising:

an outdoor circulation fan arranged to circulate air through an outdoor heat-exchange coil;

a compressor controller electrically coupled to a compressor, the compressor controller configured to:

receive a signal from a heating, ventilation, and air-conditioning (HVAC) controller to activate the compressor;

determine a start speed of the compressor;

monitor a run time of the compressor relative to a minimum run time and a desired cycle time;

determine whether the run time of the compressor is greater than a minimum run time;

responsive to a determination that the run time of the compressor is greater than the minimum run time, modulate a speed of the compressor to maintain a desired suction pressure;

determine whether the run time of the compressor is greater than or equal to a desired cycle time; and responsive to a determination that the run time of the compressor is greater than or equal to the desired cycle time, increase the speed of the compressor to lower the desired suction pressure.

15. The compressor system of claim 14, comprising a pressure sensor disposed on a suction side of the compressor.

16. The compressor system of claim 14, comprising at least one of a temperature sensor and a pressure sensor disposed on a discharge side of the compressor.

17. The compressor system of claim 14, wherein the compressor system is coupled to an indoor unit of an HVAC system that operates in at least one of an air-conditioning mode and a heating mode.

18. The compressor system of claim 17, wherein, when the HVAC system operates in the air-conditioning mode, the compressor controller modulates the speed of the compressor responsive to a suction pressure measured by a pressure sensor.

19. The compressor system of claim 17, wherein, when the HVAC system operates in the heating mode, the compressor controller modulates the speed of the compressor responsive to at least one of a refrigerant temperature in a discharge line measured by a temperature sensor and a refrigerant pressure in the discharge line measured by a pressure sensor.

20. The compressor system of claim 17, wherein the HVAC controller increases the speed of the compressor responsive to the run time of the compressor exceeding the desired cycle time of the HVAC system.

* * * * *